US009739016B2

(12) United States Patent
Kuo et al.

(10) Patent No.: US 9,739,016 B2
(45) Date of Patent: Aug. 22, 2017

(54) TRANSFORMABLE MOLDING ASSEMBLY AND METHOD OF USING THE SAME

(71) Applicant: GOLDEN ARROW PRINTING CO., LTD., New Taipei (TW)

(72) Inventors: Chien-Kuan Kuo, New Taipei (TW); Chun-Huang Huang, New Taipei (TW)

(73) Assignee: GOLDEN ARROW PRINTING CO., LTD., New Taipei (TW)

( * ) Notice: Subject to any disclaimer, the term of this patent is extended or adjusted under 35 U.S.C. 154(b) by 0 days.

(21) Appl. No.: 15/165,452

(22) Filed: May 26, 2016

(65) Prior Publication Data

US 2016/0348314 A1 Dec. 1, 2016

Related U.S. Application Data

(60) Provisional application No. 62/167,554, filed on May 28, 2015.

(51) Int. Cl.
*D21J 3/00* (2006.01)

(52) U.S. Cl.
CPC ..... *D21J 3/00* (2013.01)

(58) Field of Classification Search
CPC ..... D21F 13/00; B29C 43/006; B29C 43/361; D21J 3/00; D21J 7/00
USPC ..... 162/416
See application file for complete search history.

(56) References Cited

U.S. PATENT DOCUMENTS

2016/0168793 A1* 6/2016 Kuo ..... D21J 3/12 162/227
2016/0168800 A1* 6/2016 Kuo ..... D21J 3/00 162/218
2016/0168801 A1* 6/2016 Kuo ..... D21J 3/00 162/194
2016/0244917 A1* 8/2016 Kuo ..... D21J 3/00
2016/0362845 A1* 12/2016 Kuo ..... D21H 21/18
2016/0368235 A1* 12/2016 Kuo ..... B31B 43/00

* cited by examiner

*Primary Examiner* — Mark Halpern
(74) *Attorney, Agent, or Firm* — Osha Liang LLP

(57) ABSTRACT

The present invention provides a transformable molding assembly, which has a lower mold, an upper mold, and an activating device. The lower mold has a first plane formed with at least one cave. The upper mold has a second plane formed with at least one guide rail and at least one protrusion assembly corresponding to the at least one cave. The lower mold and the upper mold are matched with each other along a first direction by the at least one cave and the at least one protrusion assembly thereof. The activating device is linked with the upper mold. The at least one protrusion assembly comprises at least one driving element and a plurality of driven elements.

40 Claims, 12 Drawing Sheets

100

TRANSFORMABLE MOLDING ASSEMBLY AND METHOD OF USING THE SAME

This application claims the benefits of U.S. Provisional Patent Application No. 62/167,554 filed on May 28, 2015 and Taiwan Patent Application No. 104134981 filed on Oct. 23, 2015, the contents of which are incorporated herein by reference in their entirety.

BACKGROUND OF THE INVENTION

Field of Invention

The present invention relates to a transformable molding assembly and a method of using the same, and more particularly to a transformable molding assembly and a method of using the same, applied for a wet paper shape forming equipment.

Description of Prior Art

A molding assembly for the conventional wet paper-shape forming technology comprises an upper mold and a lower mold. The lower mold comprises a first plane, and at least one cave formed on the first plane. The upper mold comprises a second plane corresponding to the first plane, and at least one protrusion portion formed on the second plane to correspond with the at least one cave. By matching the first plane of the lower mold with the second plane of the upper mold, some dredged wet paper pulps are compressed on between the lower mold and the upper mold to form a rough wet-paper semi-product. While compressing in the matching manner, the lower and the upper molds both move only along a single direction, such as a vertical direction, to apply a vertically compressed force on the wet paper pulp, so that it is difficult to form a desired shape or contour for the edges, corners and/or peripherals of the wet paper product/semi-product after compressed formation; in particular, when thicknesses of the sides and/or the corners are in excess of a specific thickness, such as 1.2 mm, or a paper slurry fiber density of the wet paper pulp is too high, the sides and/or the corners of the wet paper shape product/semi-product will be unable to shape averagely and smoothly after compressed formation, such that it is easily broken or damaged in the next stages.

Hence, it is necessary to provide a transformable molding assembly and a method of using the same to solve the above drawbacks.

SUMMARY OF THE INVENTION

In order to solve the above drawbacks, an objective of the present invention is to provide a transformable molding assembly applied for wet paper shape forming equipment to shape the edges, sides, and/or corners of each wet paper shape product/semi-product averagely and smoothly, so as to avoid breakage or damage during the production process.

In order to achieve the above objective, the present invention provides a transformable molding assembly, which comprises a lower mold, an upper mold and an activation device.

The lower mold has a first plane and at least one cave formed on the first plane. The upper mold has a second plane, at least one guiding rail, and at least one protrusion assembly corresponding with the at least one cave and formed on the second plane. The lower mold and the upper mold are matched with each other along a first direction, by the at least one cave and the at least one protrusion assembly. The activation device is linked with the upper mold.

The at least one protrusion assembly comprises at least one driving element and a plurality of driven elements. The plurality of driven elements are partially disposed in the at least one guiding rail. The activation device steers the at least one driving element to apply at least one force on the plurality of driven elements, with moving the plurality of driven elements along the at least one assembly rail, to reach a manner that an assembled shape of the at least one protrusion assembly is transformed from either a first mode to a second mode or from the second mode to the first mode.

In one preferred embodiment, the at least one force is applied on the plurality of driven elements along a second direction.

In one preferred embodiment, the second direction is perpendicular to the first direction.

In one preferred embodiment, the activation device comprises one or a combination of several of a motor, a cylinder and a pump, the activation device is physically linked with the at least one driving element.

In one preferred embodiment, the at least one cave comprises a cave-top plane and a cave-surrounded plane, the at least one protrusion assembly comprises a protrusion-top plane and a protrusion-surrounded plane, the cave-top plane faces the protrusion-top plane, the cave-top plane and the protrusion-top plane are shaped correspondingly to each other, the cave-surrounded plane faces the protrusion-surrounded plane, the cave-surrounded plane and the protrusion-surrounded plane are shaped correspondingly to each other.

In one preferred embodiment, the cave-top plane can be either of a flat plane, a sphere, and any geographic plane.

In one preferred embodiment, a first area where the at least one protrusion assembly in the first mode occupies the second plane is less than a second area where the at least one protrusion assembly in the second mode occupies the second plane.

In one preferred embodiment, the at least one protrusion assembly in the second mode further comprises at least one gap used to separate the plurality of driven elements.

In one preferred embodiment, a quantity of the at least one guiding rail is the same as a quantity of the plurality of driven elements.

In one preferred embodiment, the at least one driving element comprises slopes, a quantity of which are the same as a quantity of the plurality of driven elements, the slopes are used to generate the at least one force to apply on the plurality of driven elements by slope theory.

In one preferred embodiment, the at least one driving element of the at least one protrusion assembly in the first mode is moved from inside of the second plane toward outside of the second plane or from outside of the second plane toward inside of the second plane along the first direction.

In one preferred embodiment, the upper mold further comprises at least one first spring, each of the at least one first spring comprises a first end, the first end is linked with the plurality of driven elements, the plurality of driven elements are moved toward a third direction, which is revered from the second direction, by compressed elasticity provided by the at least one first spring.

In one preferred embodiment, the at least one first spring further comprises a second end, the second end is linked with a side wall of the at least one guiding rail correspondingly.

In one preferred embodiment, the at least one first spring further comprise a second end, the second end is linked with the at least one driving element.

In one preferred embodiment, the at least one protrusion assembly further comprises at least one fixing element is used to guide the plurality of driven elements to move.

In one preferred embodiment, the upper mold further comprises a first plate and a second plate, the at least one fixing element is fixed on the first plate, the at least one driving element is fixed on the second plate, the plurality of driven elements are movably disposed on the first plate.

In one preferred embodiment, a first interval is defined between the first plate and the second plate in the first mode, a second interval is defined between the first plate and the second plate in the second mode, the second interval is less than the first interval.

In one preferred embodiment, the upper mold further comprises at least one second spring disposed between the first plate and the second plate, the at least one second spring is used to provide elasticity for moving the plurality of driven elements of the at least one protrusion assembly along the first direction.

In one preferred embodiment, each of the at least one protrusion assembly in the first mode comprises at least one gap, a first area where the at least one protrusion assembly in the first mode occupies the second plane is less than a second area where the at least one protrusion assembly in the second mode occupies the second plane.

In order to achieve the above objective, the present invention provides another transformable molding assembly, which comprises a lower mold, an upper mold, and an activation device.

The lower mold has a first plane and at least one cave is formed on the first plane. The upper mold has a second plane, at least one guiding rail and at least one protrusion assembly corresponding with the at least one cave are formed on the second plane. The lower mold and the upper mold match with each other along a first direction, with the at least one cave and the at least one protrusion assembly. The activation device is linked with the upper mold.

The at least one protrusion assembly comprises at least one driving element, a plurality of driven elements and at least one liking element. A part of the plurality of driven elements is disposed in the at least one guiding rail. The activation device steers the at least one driving element to apply at least one three to the plurality of driven elements, to make the plurality of driven elements move along the at least one guiding rail, then an assembled shape of the at least one protrusion assembly is transformed from a first mode to a second mode or from the second mode to the first mode. The at least one fixing element, which is used to guide the plurality of driven elements to move.

In one preferred embodiment, the at least one force is applied to the plurality of driven elements along a second direction.

In one preferred embodiment the second direction is perpendicular to the first direction.

In one preferred embodiment, the activation device comprises one or a combination of a motor, a cylinder and a pump, the activation device physically is linked with the at least one driving element.

In one preferred embodiment, the at least one cave comprises a cave-top plane and a cave-surrounded plane, the at least one protrusion assembly comprises a protrusion-top plane and a protrusion-surrounded plane, the cave-top plane faces the protrusion-top plane, the cave-top plane and the protrusion-top plane are shaped correspondingly to each other, the cave-surrounded plane faces the protrusion-surrounded plane, the cave-surrounded plane and the protrusion-surrounded plane are shaped correspondingly to each other.

In one preferred embodiment, the cave-top plane can be either of a flat plane, a sphere, and any geographic plane.

In one preferred embodiment, a first area on the second plane occupied by the at least one protrusion assembly in the first mode is less than a second area on the second plane occupied by the at least one protrusion assembly in the second mode.

In one preferred embodiment, the at least one protrusion assembly in the second mode further comprises at least one gap, which is used to separate the plurality of driven elements.

In one preferred embodiment, a quantity of the at least one guiding rail is the same as a quantity of the plurality of driven elements.

In one preferred embodiment, the at least one driving element comprises slopes which are the same as a quantity of the plurality of driven elements, the slopes generate the at least one force to apply on the plurality of driven elements by slope theory.

In one preferred embodiment, the at least one driving element of the at least one protrusion assembly in the first mode is moved from inside of the second plane toward outside of the second plane or from outside of the second plane toward inside of the second plane along the first direction.

In one preferred embodiment, the upper mold further comprises at least one first spring, each of the at least one first spring comprises a first end, the first end is linked with the plurality of driven elements, the plurality of driven elements are moved toward a third direction, which is revered from the second direction, by compressed elasticity provided by the at least one first spring.

In one preferred embodiment, the at least one first spring further comprises a second end, the second end is linked with a side wall of the at least one guiding rail correspondingly.

In one preferred embodiment, the at least one first spring further comprise a second end, the second end is linked with the at least one driving element.

In one preferred embodiment, the upper mold further comprises a first plate and a second plate, the at least one fixing element is fixed on the first plate, the at least one driving element is fixed oil the second plate, the plurality of driven elements are movably disposed on the first plate.

In one preferred embodiment, a first interval is defined between the first plate and the second plate in the first mode, a second interval is defined between the first plate and the second plate in the second mode, the second interval is less than the first interval.

In one preferred embodiment, the upper mold further comprises at least one second spring disposed between the first plate and the second plate, the at least one second spring is used to provide elasticity for moving the plurality of driven elements of the at least one protrusion assembly along the first direction.

In one preferred embodiment, each of the at least one protrusion assembly comprises at least one gap in the first mode, a first area on the second plane occupied by the at least one protrusion assembly in the first mode is less than a second area on the second plane occupied by the at least one protrusion assembly in the second mode.

In order to achieve the above objective, the present invention provides a driving method for a transformable molding assembly, which comprises:

First, an upper mold is disposed. The upper mold comprises a second plane, at least one guiding rail and at least one protrusion assembly. The at least one protrusion assembly comprises at least one driving element and a plurality of driven elements. The at least one protrusion assembly comprises a protrusion-top plane and a protrusion-surrounded plane.

Then, a wet paper pulp is dredged by a lower mold in a slurry tank, to make the wet paper pulp in at least one cave of the lower mold. A shape of the at least one cave corresponds with the at least one protrusion assembly. The at least one cave comprises a cave-top plane and a cave-surrounded plane. The cave-top plane faces the protrusion-top plane.

Then, the lower mold and the upper mold match with each other along a first direction, to combine the at least one cave and the at least one protrusion assembly to compress part of the wet paper pulp on the cave-top plane.

Then, the plurality of driven elements are driven by the at least one driving element, to move along the at least one guiding rail, an assembled shape of the at least one protrusion assembly is transformed from a first mode to a second mode to compress at least one corner of the cave-surrounded plane.

Then, the plurality of driven elements are driven by the at least one driving element, to move along the at least one guiding rail, the assembled shape of the at least one protrusion assembly is transformed from the second mode to the first mode.

Then, the plurality of driven elements compress to at least one phase of the cave-surrounded plane, in order along at least one second direction, the second direction is perpendicular to the first direction.

The protrusion-top plane and the protrusion-surrounded plane are both smooth in the first mode, each of the at least one protrusion assembly further comprises at least one gap in the second mode, the at least one gap exists between the plurality of driven elements.

In order to achieve the above objective, the present invention provides a driving method for a transformable molding assembly, which comprises:

First, an upper mold is disposed. The upper mold comprises a second plane, at least one guiding rail and at least one protrusion assembly. The at least one protrusion assembly comprises at least one driving element and a plurality of driven elements. The at least one protrusion assembly comprises a protrusion top plane and a protrusion-surrounded plane.

Then, a wet paper pulp is dredged by a lower mold in a slurry tank, to make the wet paper pulp in at least one cave of the lower mold. A shape of the at least one cave corresponds with the at least one protrusion assembly. The at least one cave comprises a cave-top plane and a cave-surrounded plane. The cave-top plane laces the protrusion-top plane.

Then, the lower mold and the upper mold match with each other along a first direction, to combine the at least one cave and the at least one protrusion assembly to compress a part of the wet paper pulp on the cave-top plane.

Then, the plurality of driven elements are driven by the at least one driving element, to move along the at least one guiding rail, an assembled shape of the at least one protrusion assembly is transformed from a first mode to a second mode to compress all of the cave-surrounded plane.

The protrusion-top plane and the protrusion-surrounded plane are both smooth in the first mode, the protrusion-surrounded plane is smooth in the second mode.

In order to achieve the above objective, the present invention provides a driving method for a transformable molding assembly, which comprises:

First, an upper mold is disposed. The upper mold comprises a second plane, at least one guiding rail and at least one protrusion assembly. The at least one protrusion assembly comprises at least one driving element and a plurality of driven elements. The at least one protrusion assembly comprises a protrusion-top plane and a protrusion-surrounded plane.

Then, a wet paper pulp is dredged by a lower mold in a slurry tank, to make the wet paper pulp in at least one cave of the lower mold. A shape of the at least one cave corresponds with the at least one protrusion assembly. The at least one cave comprises a cave-top plane and a cave-surrounded plane. The cave-top plane faces the protrusion-top plane.

Then, the lower mold and the upper mold match with each other along a first direction, to combine the at least one cave and the at least one protrusion assembly and to make the at least one driving element drive the plurality of driven elements to move along the at least one guiding rail, in order to make an assembled shape of the at least one protrusion assembly transform from a first mode to a second mode to compress parts of the wet paper pulp on the cave-top plane and the cave-protrusion plane.

The protrusion-top plane and the protrusion-surrounded plane are both smooth in the second mode.

With comparison with the conventional art, the present invention ensures that a shape of sides and/or corners of a wet paper pulp can formed average and smooth daring a wet-paper formation process, by the transformable molding assembly and the driving method of using the same, even if the thickness of the sides and/or corners of the wet paper pulp needs to exceed 1.2 mm.

DETAILED DESCRIPTION OF THE PREFERRED EMBODIMENTS

The following description of each embodiment, with reference to the accompanying drawings, is used to exemplify specific embodiments which may be carried out in the present invention. The claims of the present invention are not limited by these embodiments.

Figure 1:
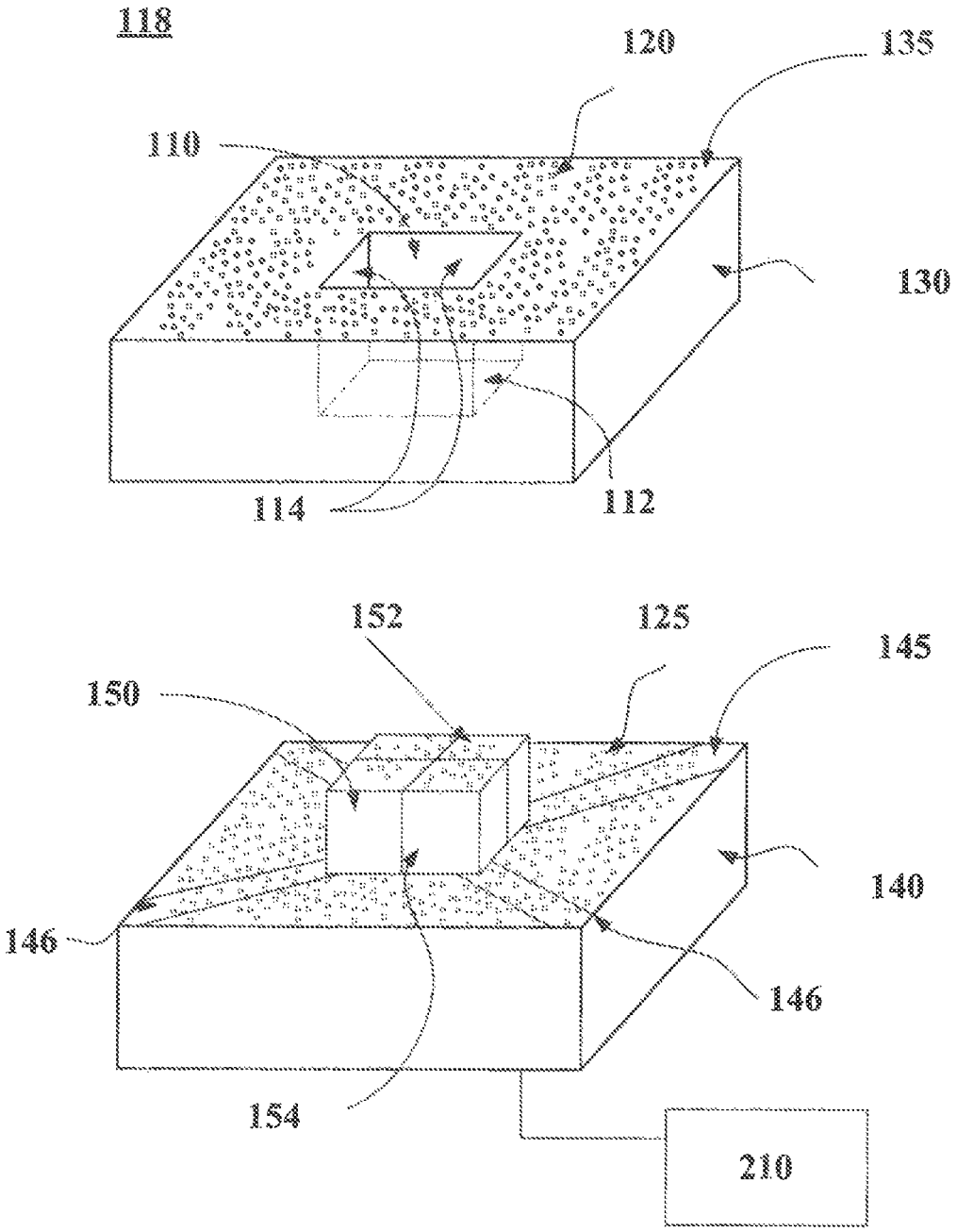
FIG. 1 is a stereoscopic drawing of a transformable molding assembly according to the present invention.
Figure 2:
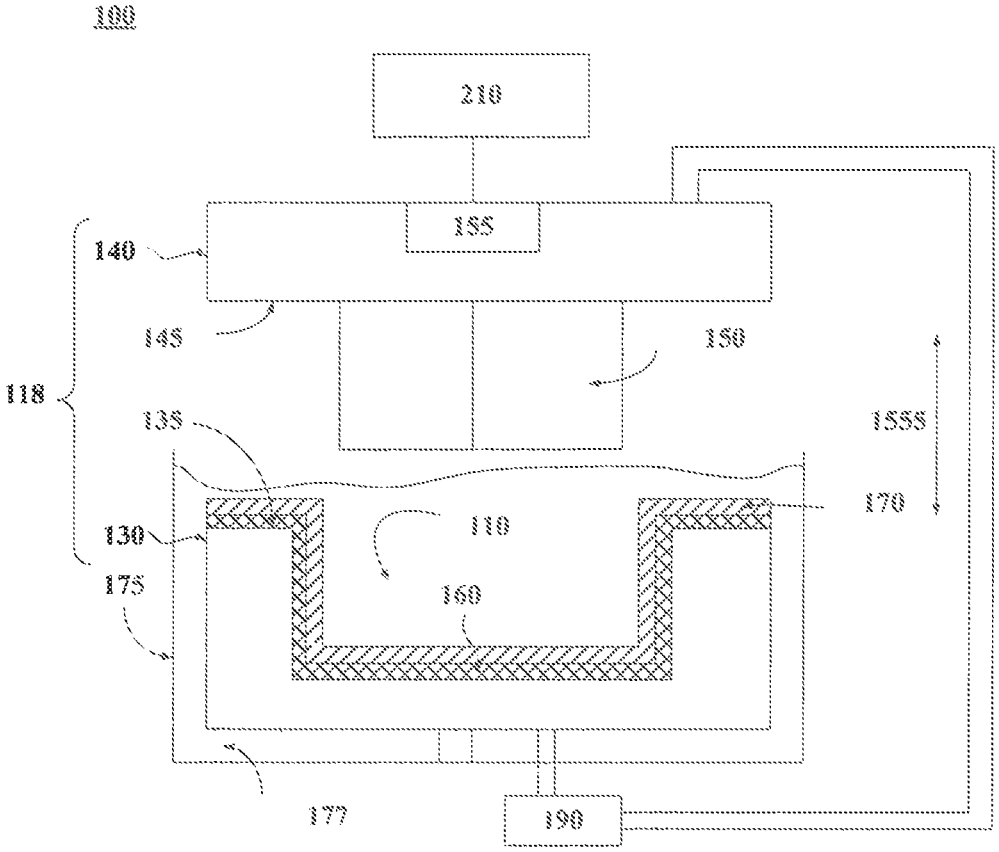
FIG. 2 is a side drawing of the transformable molding assembly at a dis-matching mode according to the present invention.

Please refer to FIGS. 1 and 2. FIG. 1 is a stereoscopic drawing of a transformable molding assembly 118 according to the present invention. FIG. 2 is a side drawing of the transformable molding assembly 118 at a dis-matching, mode according to the present invention.

As FIG. 2 shows, the wet-paper dredging system 100 comprises a slurry tank 175, a transformable molding assembly 118, a mesh 160 and a suction device 190. The slurry tank is used to store paper slurry 177. The transformable molding assembly 118 comprises a lower mold 130, an upper mold 140, and an activation device 210.

As FIGS. 1 and 2 show, the lower mold 130 has a first plane 135 and at least one cave 110 and at least one first through hole 120 are formed on the first plane 135. The at least one cave 110 comprises a cave-top plane 112 and a cave-surrounded plane 114, which is surrounded the cave-top plane 112. The cave-top plane 112 is either of flat plane, a sphere, and any geographic plane. The upper mold 140 has a second plane 145, at least one guiding rail 146, and at least one protrusion assembly 150 corresponding with the at least one cave 110 formed on the second plane 145. The at least one protrusion assembly 150 comprises a protrusion-top plane 152 and a protrusion-surrounded plane 154, which is surrounded the protrusion-top plane 152. The lower mold and the upper mold are matched with each other along a first direction, by the at least one cave and the at least one protrusion assembly. The activation device is linked with the upper mold.

As FIGS. 1 and 2 show, in the wet-paper formation process, the lower mold 130 dredges the paper slurry 177 from the slurry tank 175, to form a wet paper pulp 170 on the first plane 135 and the at least one cave 110 of the lower mold 130. Then, the lower mold 130 and the upper mold 140 are matched on a first direction 1555 (such as vertical direction), to make the at least one cave 110 and the at least one protrusion assembly 150 to combine compressed. The cave-top plane 112 faces the protrusion-top plane 152 closely; the cave-top plane 112 and the protrusion-top plane 152 are shaped correspondingly to each other. The cave-surrounded plane 114 faces the protrusion-surrounded plane 154 closely; the cave-surrounded plane 114 and the protrusion-surrounded plane 154 are shaped correspondingly to each other.

As shown in FIGS. 1 and 2, the Activation device 210 is linked with the upper mold 140. Preferably, the activation device 210 can be one or a combination of several of a motor a cylinder, and a pump.

Figure 3:
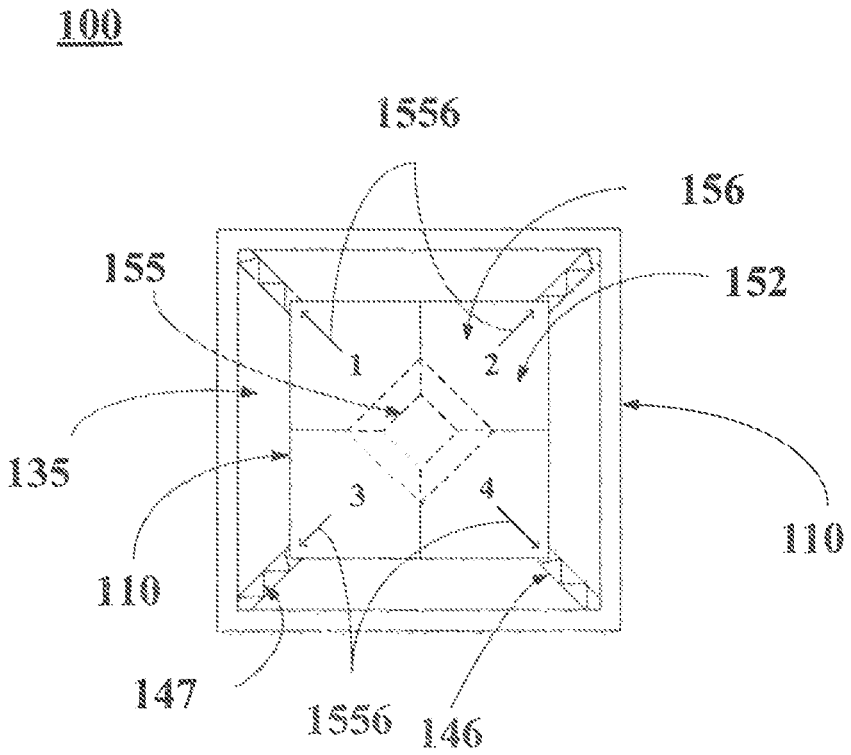
FIG. 3 is a top drawing of the molding assembly of a first preferred embodiment at a first stage of a first mode according to the present invention.

FIG. 3 is a top drawing of the molding assembly 118 of a first preferred embodiment according to the present invention at a first stage of a first mode. As FIGS. 2 and 3 show, the at least one protrusion assembly 150 comprises at least one driving element 155 and a plurality of driven elements 156. The plurality of driven elements 156 are partially disposed in the at least one guiding rail 146. The upper mold 140 further has at least one first spring 147, each of the at least one first spring 147 comprises a first end and a second end. The first end is linked with the plurality of driven elements 56 and the second end is linked with a side wall relatively with the at least one guiding rail 146. The activation device 210 is physically linked with the at least one driving element 155. In the first stage of the first mode, the plurality of driven elements 156 constitute the top-protrusion plane co-planer, to perform compression formation process along the first direction 1555 to a part of the wet paper pulp 170, which is on the cave-top plane 112 of the lower mold 130.

Figure 4:
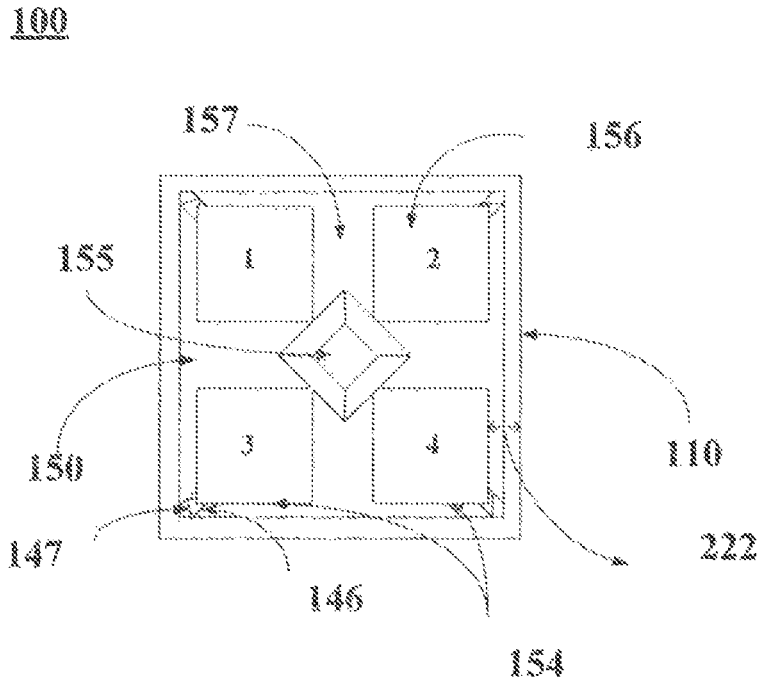
FIG. 4 is a side viewing according to the molding assembly according to FIG. 3 of a second mode.
Figure 5:
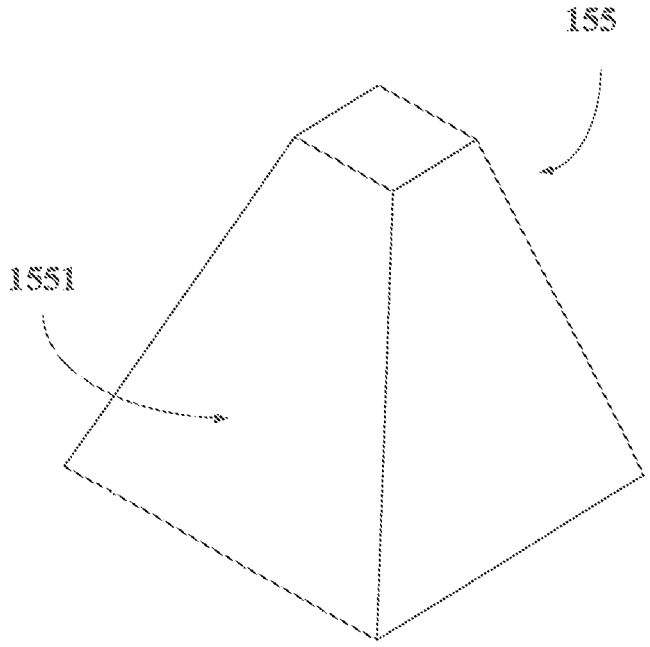
FIG. 5 is a stereoscopic viewing of the driving element of FIG. 3.

Refer to FIGS. 3 and 4, FIG. 4 is a side viewing according to the molding assembly 118 according to FIG. 3 or a second mode. The difference between the second mode and the first mode is the at least one driving element 155 is brought to move along the first direction (such as vertical direction) by the activation device 210, from outside of the second plane 145 of the upper mold 140 gradually towards inside of the second plane 145 of the upper mold 140. Please further refer to FIG. 5. FIG. 5 is a stereoscopic viewing of the driving element 155 of FIG. 3. The driving element 155 comprises slopes 1551 which are the same as a quantity of the plurality of driven elements 156. For example, the driving element 155 is a pyramid with four slopes 1511, to correspond with four driven elements 156. While the driving element 155 is moving, each of the slopes 1511 generates a force by slope theory on outer surface of the four driven elements 156 respectively. Because each of the forces is applied on the four driven elements 156 along a second direction 1556 (such as a horizontal direction), which is perpendicular with the first direction 1555, to drive the for driven elements 156 to move outwards along corresponding guiding rails 146, to make the four driven elements 156 to compress the at least one first spring 147, then an assembled shape of the at least one protrusion assembly 150 is transformed from a first mode to a second mode (as FIG. 4 shows). The at least one protrusion assembly 150 in the second mode further comprises at least one gap 157, which is used to separate the four driven elements 156, and the four driven elements 156 are moved toward the corners (there are four corners in the preferred embodiment), to perform the compressed formation process to the four corners of the wet paper pulp 170 along the second direction 1556.

As FIGS. 3 and 4 show, a first area were the at least one protrusion assembly 150 in the first mode occupies the second plane 145 is less than a second area where the at least one protrusion assembly 150 in the second mode occupies the second plane 143. While the at least one protrusion assembly 150 is transformed to the first mode from the second mode, the activation device 210 bring the at least one driving element 155 to move along the first direction 1555 from inside of the second plane 145 towards outside of the second plane 145, and the plurality of driven elements 156 move along the at least one guiding rail 147 on a third direction, which is reversed with the second direction 1556, by a compressed elasticity provided by the at least one first spring 147.

Figure 6:
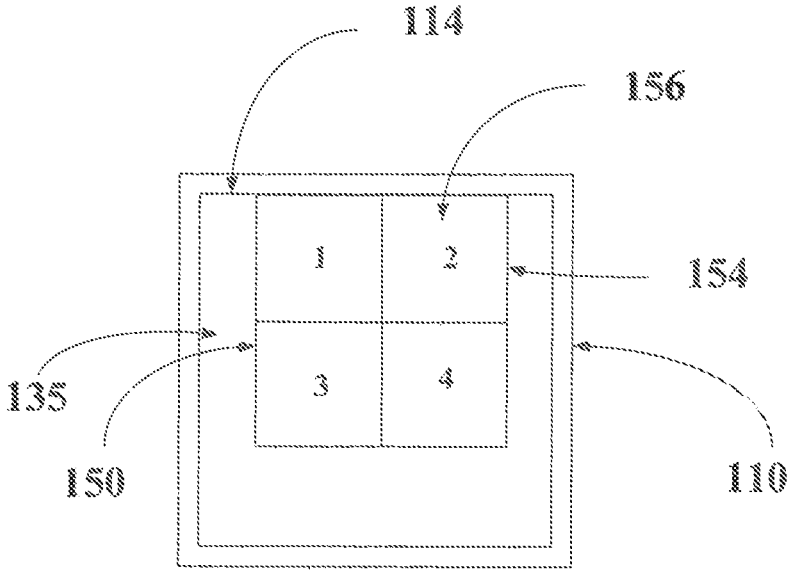
FIG. 6 is a top drawing of the molding assembly according to FIG. 3 at a second stage of a first mode.
Figure 7:
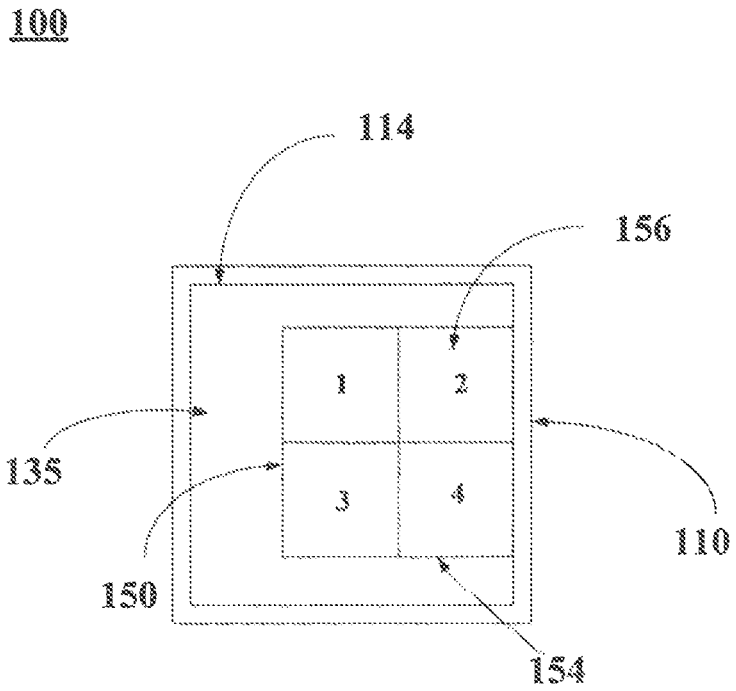
FIG. 7 is a top drawing of the molding assembly according to FIG. 3 at a third stage of a first mode.
Figure 8:
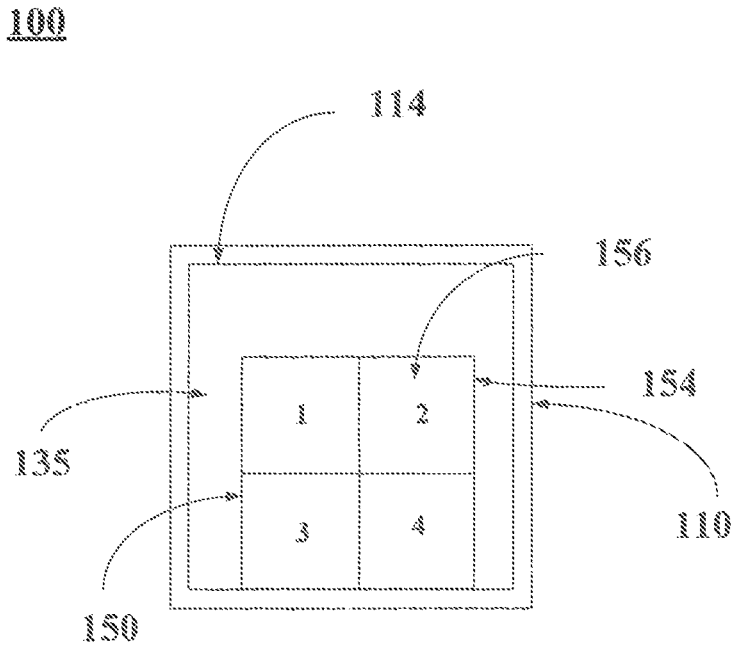
FIG. 8 is a top drawing the molding assembly according to FIG. 3 at a fourth stage of a first mode.
Figure 9:
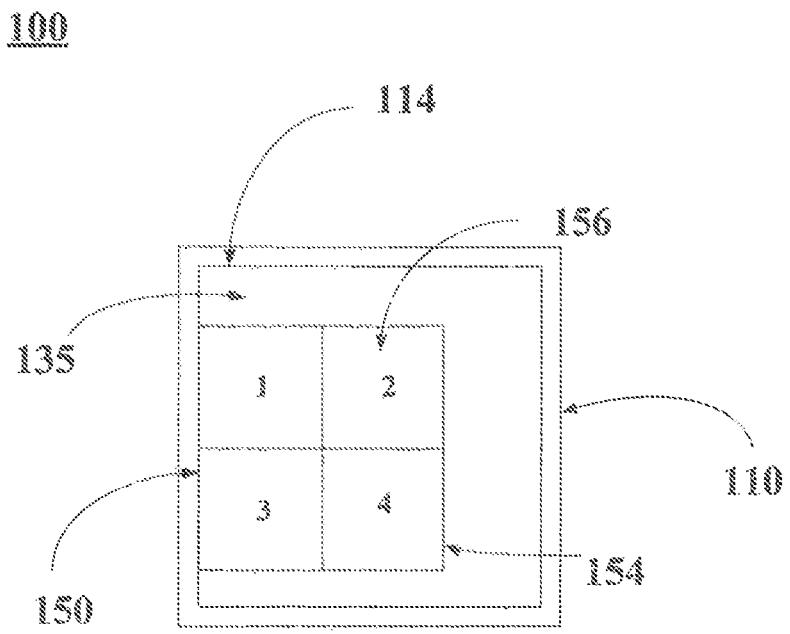
FIG. 9 is a top drawing of the molding assembly according to FIG. 3 at a fifth stage of a first mode.

FIG. 6 is a top drawing of the molding assembly according to FIG. 3 at a second stage of a first mode. FIG. 7 is a top drawing of the molding assembly according to FIG. 3 at a third stage of a first mode. FIG. 8 is a top drawing of the molding assembly according to FIG. 3 at a fourth stage of a first mode. FIG. 9 is a top drawing of the molding assembly according to FIG. 3 at a fifth stage or a first mode. The difference between each stage of FIGS. 6-9 and the first stage is: the at least one protrusion assembly 150 orderly squeezes to form four vertical sides of the wet paper pulp, between the cave-surrounded plane 114 and the protrusion-surrounded plane 154.

Figure 10:
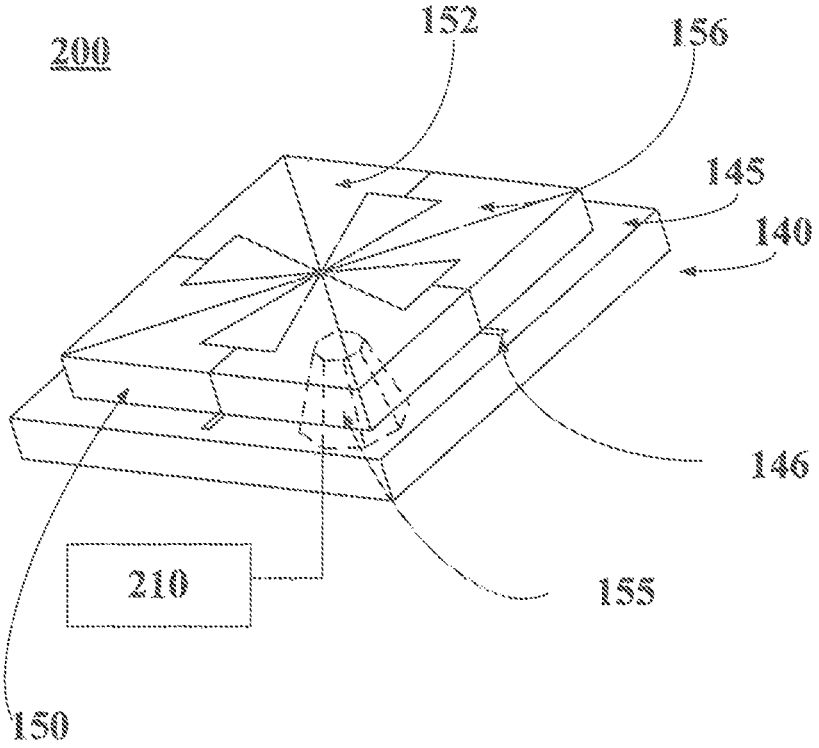
FIG. 10 is a stereoscopic drawing of an upper mold of the molding assembly of a second preferred embodiment of a first mode according to the present invention.
Figure 11:
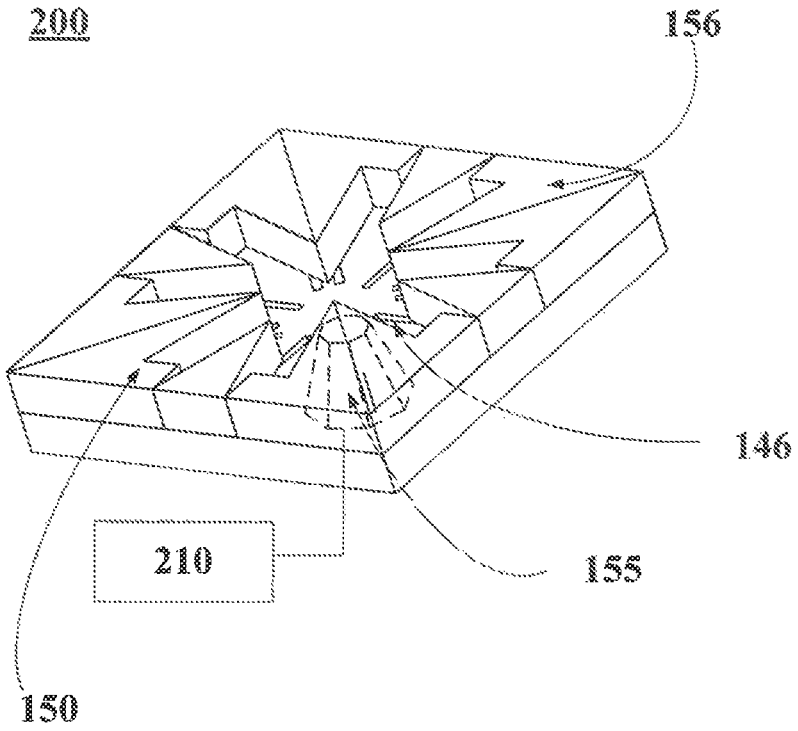
FIG. 11 is a stereoscopic drawing of an upper mold of the molding assembly of a second preferred embodiment of a second mode according to the present invention.
Figure 12:
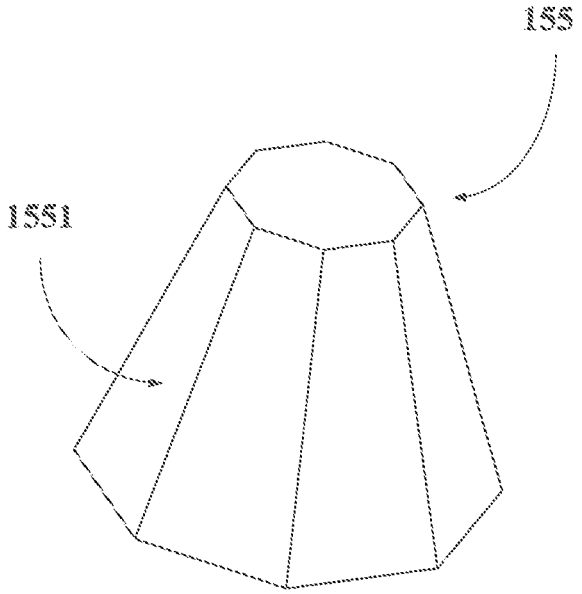
FIG. 12 is a stereoscopic drawing of the driving element of FIG. 1.

Please refer to FIGS. 10-11. FIG. 10 is a stereoscopic drawing, of an upper mold 140 of the molding assembly 118 of a second preferred embodiment according to the present invention of a first mode, FIG. 11 is a stereoscopic drawing of an upper mold 140 of the molding assembly 118 of a second preferred embodiment according to the present invention of a second mode. The difference between the second preferred embodiment and the first preferred embodiment is: in the second preferred embodiment, the protrusion-top plane 152 of the protrusion assembly 150 in the first mode is used to squeeze a bottom plane of the wet paper pulp. While the driving element 155 is brought by the activation device 210, to move along the first direction (vertical direction) from outside of the second plane 145 of the upper mold 140 towards the inside of the second plane 145 of the upper mold 140; please further refer to FIG. 12, which is a stereoscopic drawing of the driving element 155 of FIG. 11. The driving element 155 is a pyramid with eight slopes 1511, to correspond with eight driven elements 156. While the driving element 155 moving, each of the slopes 1511 generates a force by slope theory to outer surface of the eight driven elements 156 respectively, to make the eight driven elements 156 of the protrusion assembly 150 radially are moved toward outside along the second plane 145, to transform as the protrusion assembly 150 in the second mode, and to squeeze peripheral walls of the wet paper pulp respectively at the same time; with comparison with the first preferred embodiment, the second preferred embodiment performs squeeze formation to all side walls only with once of second mode.

Figure 13:
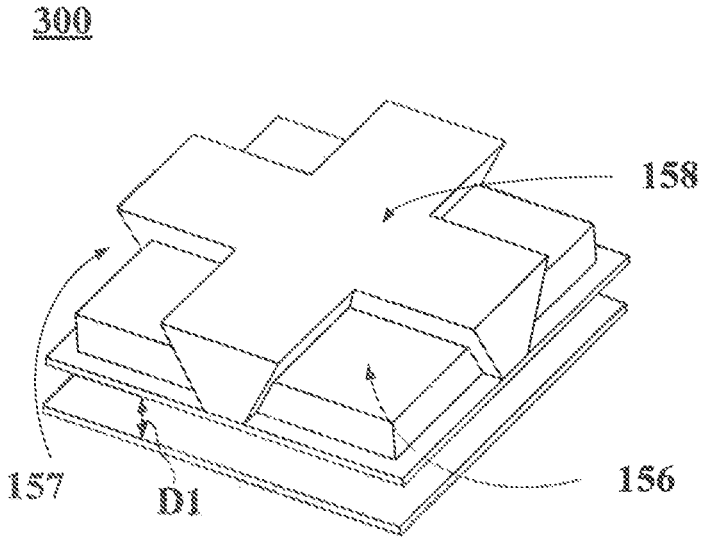
FIG. 13 is a stereoscopic drawing of an upper mold of the molding assembly of a third preferred embodiment of a first mode according to the present invention.
Figure 14:
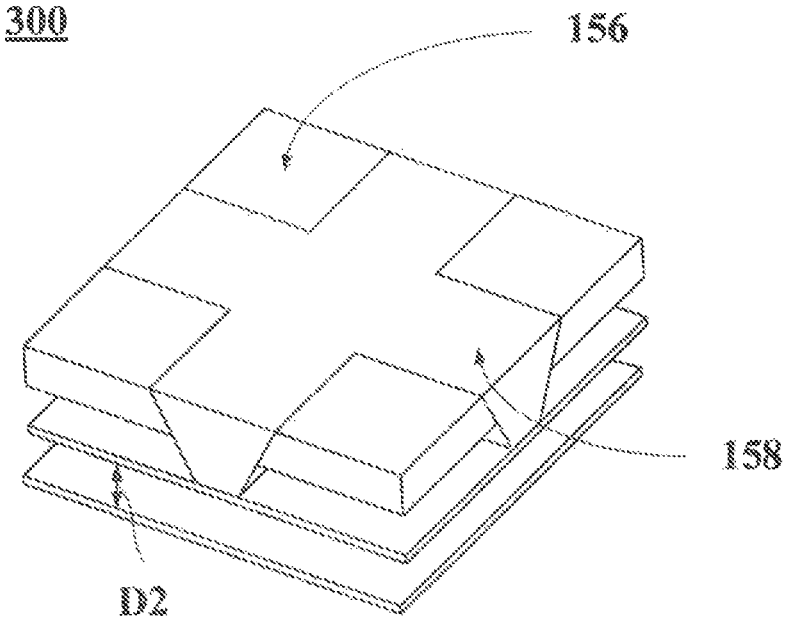
FIG. 14 is a stereoscopic drawing of an upper mold of the molding assembly of a third preferred embodiment of a second mode according to the present invention.
Figure 15:
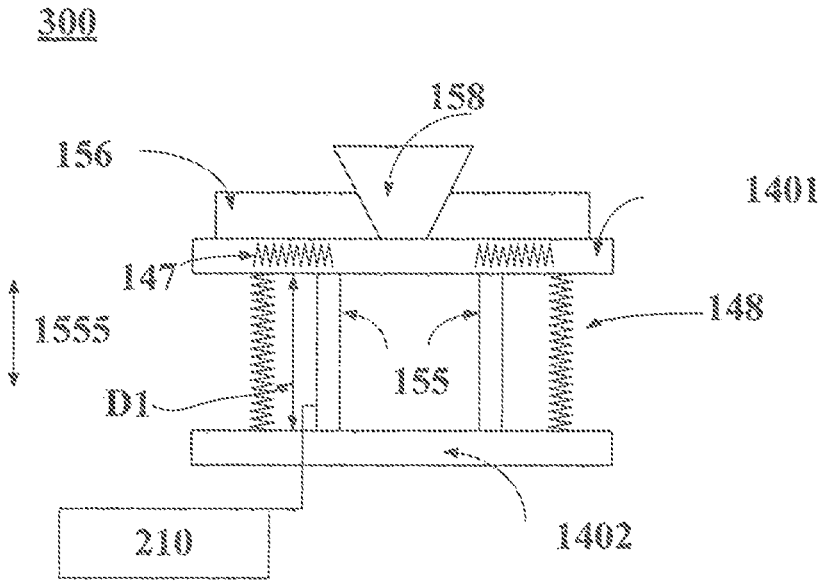
FIG. 15 is a side viewing of FIG. 14.

Please refer to FIGS. 13-15. FIG. 13 is a stereoscopic drawing of an upper mold of the molding assembly of a third preferred embodiment of a first mode according to the present invention. FIG. 14 is a stereoscopic drawing of an upper mold of the molding assembly of a third preferred embodiment of a second mode according to the present invention. FIG. 15 is a side viewing of FIG. 14. The differences between the third preferred embodiment and the first preferred embodiment are: 1. the at least one protrusion assembly 150 further comprises at least one fixing element 158. The at least one fixing element 158 comprises a plurality of slopes which are used to guide the plurality of driven elements 156 to move forwards; 2. The upper mold 140 further comprises a first plate 1401 and a second plate 1402. The at least one fixing element 158 is fixed on the first plate 1401. The at least one driving element 155 is fixed on the second plate 1402, the plurality of driven elements 156 are forward-movable disposed on the first plate 1401; 3. The upper mold 140 further comprises at least one second spring 148 disposed between the first plate 1401 and the second plate 1402, the at least one second spring 148 is used to provide elasticity for moving the plurality of driven elements 156 of the at least one protrusion assembly 150 along the first direction 1555. 4. Each of the at least one protrusion assembly 150 comprises at least one gap 157 in the first mode, a first area on the second plane 145 occupied by the at least one protrusion assembly 150 in the first mode is less than a second area on the second plane 145 occupied by the at least one protrusion assembly 150 in the second mode. A first interval D1 is defined between the first plate 1401 and the second plate 1402 in the first mode, the second spring 148 does not receive force to make the protrusion assembly 150 maintain in the first mode. A second interval D2 is defined between the first plate 1401 and the second plate 1402 in the second mode, the second interval D2 is less than the first interval D1 because the second spring 148 is applied by a force, the force keeps the protrusion assembly 150 maintaining in the second mode. Hence, in the third preferred embodiment, the protrusion assembly 150 in the first mode is unable to perform a squeeze formation to any plane of the wet paper pulp; however, the protrusion assembly 150 in the second mode can perform the squeeze formation to the bottom plane and the side walls of the wet paper pulp 170 at the same time. Hence, with comparison with the first preferred embodiment, the third preferred embodiment can simplify more procedures.

Figure 16:
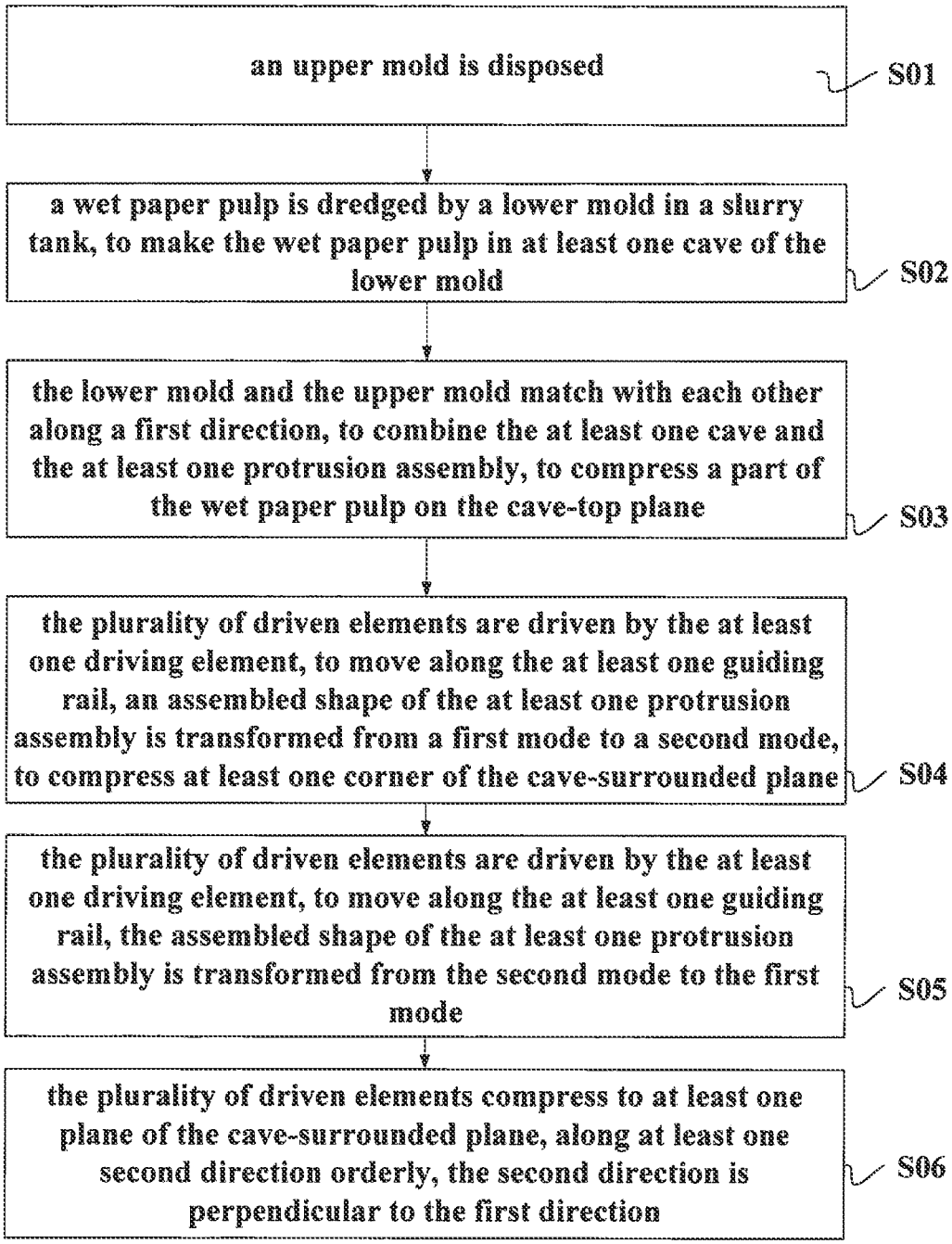
FIG. 16 is a flow diagram of a first driving method of the transformable molding assembly according to the present invention.

FIG. 16 is a flow diagram of a first driving method of the transformable molding assembly according to the present invention. Please refer to the elements of FIGS. 1-5, no more description is mentioned. First, proceeding step S01, an upper mold 140 is disposed. Then, proceeding a step S02, a wet paper pulp 170 is dredged by a lower mold 130 in a slurry tank 175, to make the wet paper pulp 170 in at least one cave 110 and the first plane 135 of the lower mold 130. Then, proceeding a step S03, the lower mold 130 and the upper mold 140 match with each other along a first direction 1555, to combine the at least one cave 110 and the at least one protrusion assembly 150 to compress a part of the wet paper pulp 170 on the cave-top plane 112. Then, proceeding a step S04, the plurality of driven elements 156 are driven by the at least one driving element 355, to move along the at least one guiding rail 146, an assembled shape of the at least one protrusion assembly 150 is transformed from a first mode to a second mode to compress at least one corner of the cave-surrounded plane 114. Then, proceeding a step S05, the plurality of driven elements 156 are driven by the at least one driving element 155, to move along the at least one guiding rail 146, the assembled shape of the at least one protrusion assembly 150 is transformed from the second mode to the first mode. Then, proceeding a step S06, the plurality of driven elements 156 compress to at least one plane of the cave-surrounded plane 114, in order along at least one second direction 1556.

In the driving method, The protrusion-top plane 152 and the protrusion-surrounded plane 154 are both smooth in the first mode, so it is able to perform the squeeze formation to the wet paper pulp 170 on the cave-top plane 112 and the cave-surrounded plane 114; each of the at least one protrusion assembly further comprises at least one gap 157 in the second mode, the at least one gap 157 exists between the plurality of driven elements 156, the main purpose of the second mode is merely to perform the squeeze formation to the corners of the cave-surrounded plane 114.

Figure 17:
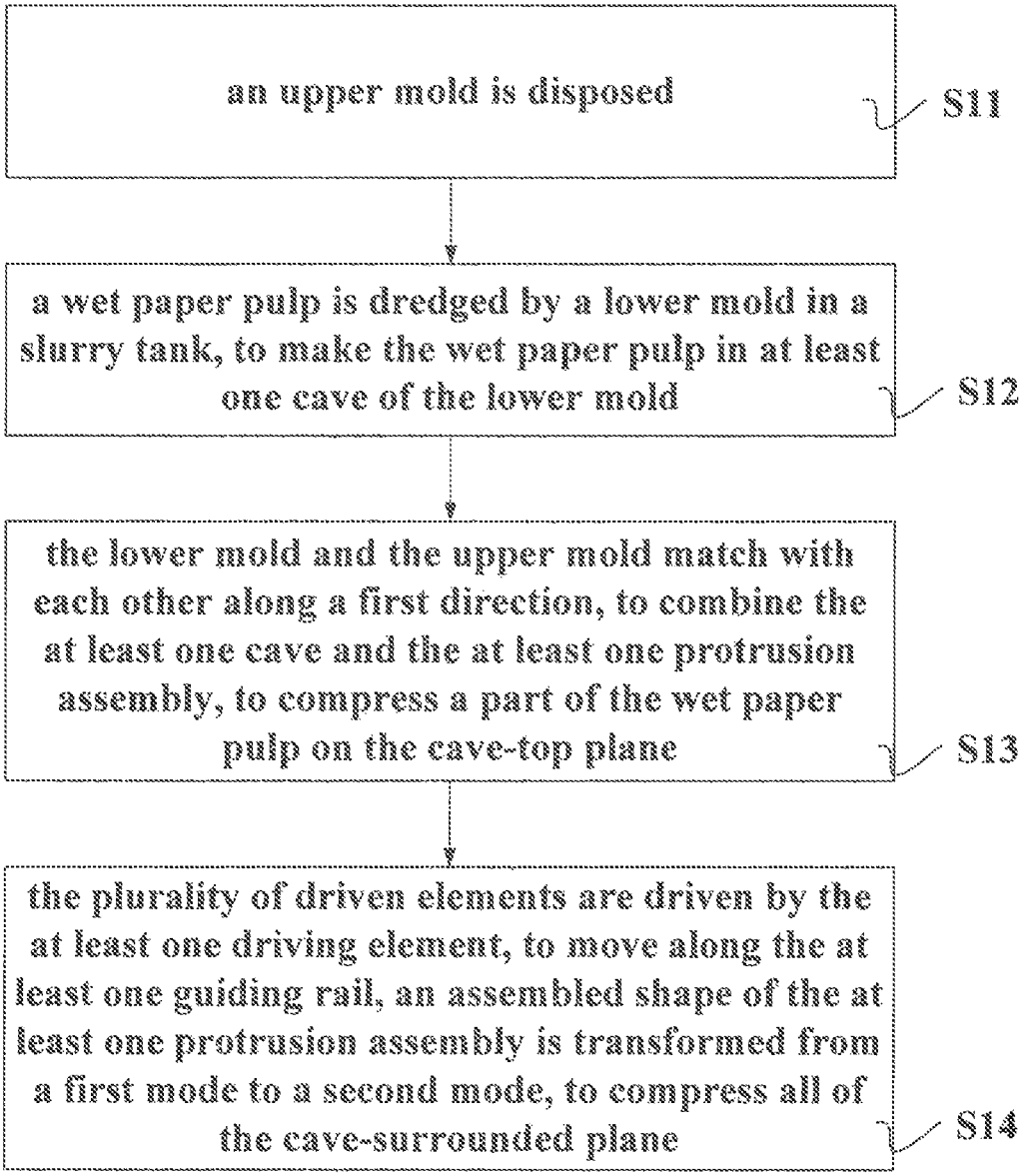
FIG. 17 is a flow diagram of a second driving method of the transformable molding assembly according to the present invention.

FIG. 17 is a flow diagram of a second driving method of the transformable molding assembly 118 according to the present invention. First, proceeding step S11, an upper mold 140 is disposed. Then, proceeding a step S12, a wet paper pulp 170 is dredged by a lower mold 130 in a slurry tank 175, to make the wet paper pulp 170 in at least one cave 110 and the first plane 135 of the lower mold 130. Then, proceeding a step S13, the lower mold 130 and the upper mold 140 match with each other along a first direction 1555, to combine the at least one cave 110 and the at least one protrusion assembly 150 to compress a part of the wet paper pulp 170 on the cave-top plane 112. Then, proceeding a step S14, the plurality of driven elements 156 are driven by the at least one driving element 155, to move along the at least one guiding rail 146, an assembled shape of the at least one protrusion assembly 150 is transformed from a first mode to a second mode to compress all of the cave-surrounded plane 114.

In the driving method, the protrusion-top plane 152 and the protrusion-surrounded plane 154 are both smooth in the first mode, however the protrusion assembly 150 is used to perform the squeeze formation to the part of the wet paper pulp 170 on the cave-top plane 112; the protrusion-surrounded plane 154 is smooth in the second mode, so the protrusion assembly 150 is used to perform the squeeze formation to the part of the wet paper pulp 170 on the cave-surrounded plane 114.

Figure 18:
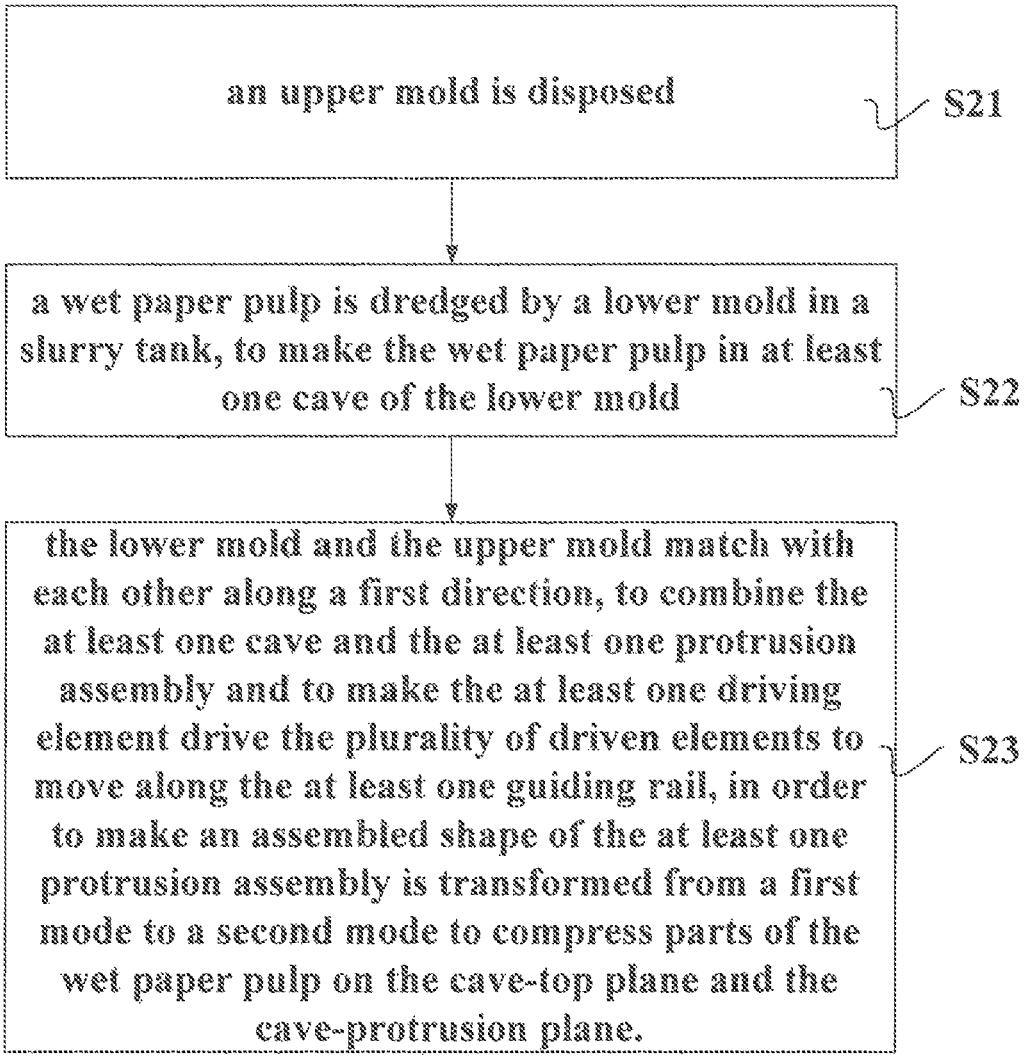
FIG. 18 is a flow diagram of a third driving method of the transformable molding assembly according to the present invention.

FIG. 18 is a flow diagram of a third driving method of the transformable molding assembly according to the present invention. First, proceeding step S31, an upper mold 140 is disposed. Then, proceeding a step S32, a wet paper pulp 170 is dredged by a lower mold 130 in a slurry tank 175, to make the wet paper pulp 170 in at least one cave 110 and the first plane 135 of the lower mold 130. Then, proceeding a step S33, the lower mold 130 and the upper mold 140 match with each other along a first direction 1555, to combine the at least one cave 110 and the at least one protrusion assembly 150 and to make the at least one driving element 155 to drive the plurality of driven elements 156 to move along the at least one guiding rail 146, to make an assembled shape of the at least one protrusion assembly 150 transform from a first mode to a second mode to compress parts of the wet paper pulp 170 on the cave-top plane 112 and the cave-protrusion plane 114.

In the driving method, the protrusion-top plane 152 and the protrusion-surrounded plane 154 are both smooth in the second mode, so the protrusion assembly 150 is able to perform the squeeze formation to the parts of the wet paper pulp 170 on the cave-top plane 112 and the cave-surrounded plane 114 at the same time.

Although the present invention has been disclosed as preferred embodiments, the scope of the claims of the present invention must be defined. The foregoing preferred embodiments are not intended to limit the present invention.

What is claimed is:

1. A transformable molding assembly, for a wet paper-shape forming equipment, comprising:

a lower mold, having a first plane and at least one cave formed on the first plane;

an upper mold, having a second plane, and at least one guiding rail and at least one protrusion assembly, corresponding with the at least one cave, formed on the second plane, wherein the lower mold and the upper mold are matched with each other along a first direction, by the at least one cave and the at least one protrusion assembly; and an activation device, linked with the upper mold;

wherein the at least one protrusion assembly comprises at least one driving element and a plurality of driven elements, the plurality of driven elements are partially disposed in the at least one guiding rail, the activation device steers the at least one driving element to apply at least one force on the plurality of driven elements, with moving the plurality of driven elements along the at least one guiding rail, to reach a manner that an assembled shape of the at least one protrusion assembly is transformed from either a first mode to a second mode or from the second mode to the first mode.

2. The transformable molding assembly according to claim 1, wherein the at least one force is applied on the plurality of driven elements along a second direction.

3. The transformable molding assembly according to claim 2, wherein the upper mold further comprises at least one first spring, each of the at least one first spring comprises a first end, the first end is linked with the plurality of driven elements, the plurality of driven elements are moved toward a third direction opposite to the second direction, by compressed elasticity provided by the at least one first spring.

4. The transformable molding assembly according to claim 3, wherein the at least one first spring further comprises a second end, the second end is linked with a side wall of the at least one guiding rail, correspondingly.

5. The transformable molding assembly according to claim 3, wherein the at least one first spring further comprise a second end, the second end is linked with the at least one driving element.

6. The transformable molding assembly according to claim 3, wherein the at least one protrusion assembly further comprises at least one fixing element used to guide the plurality of driven elements to move.

7. The transformable molding assembly according to claim 6, wherein the upper mold further comprises a first plate and a second plate, the at least one fixing element is fixed on the first plate, the at least one driving element is fixed on the second plate, the plurality of driven elements are movably disposed on the first plate.

8. The transformable molding assembly according to claim 7, wherein a first interval is defined between the first plate and the second plate in the first mode, a second interval is defined between the first plate and the second plate in the second mode, the second interval is less than the first interval.

9. The transformable molding assembly according to claim 8, wherein the upper mold further comprises at least one second spring disposed between the first plate and the second plate, the at least one second spring is used to provide elasticity for moving the plurality of driven elements of the at least one protrusion assembly along the first direction.

10. The transformable molding assembly according to claim 1, wherein the second direction is perpendicular to the first direction.

11. The transformable molding assembly according to claim 1, wherein the activation device comprises one or a combination of several of a motor, a cylinder, and a pump, the activation device is physically linked with the at least one driving element.

12. The transformable molding assembly according to claim 1, wherein the at least one cave comprises a cave-top plane and a cave-surrounded plane, the at least one protrusion assembly comprises a protrusion-top plane and a protrusion-surrounded plane, the cave-top plane faces the protrusion-top plane, the cave-top plane and the protrusion-top plane are shaped correspondingly to each other, the cave-surrounded plane faces the protrusion-surrounded plane, and the cave-surrounded plane and the protrusion-surrounded plane are shaped correspondingly to each other.

13. The transformable molding assembly according to claim 1, wherein the cave-top plane can be either of a flat plane, a sphere, and any geographic plane.

14. The transformable molding assembly according to claim 1, wherein a first area where the at least one protrusion assembly in the first mode occupies the second plane is less than a second area where the at least one protrusion assembly in the second mode occupies the second plane.

15. The transformable molding assembly according to claim 1, wherein the at least one protrusion assembly in the second mode further comprises at least one gap used to separate the plurality of driven elements.

16. The transformable molding assembly according to claim 1, wherein a quantity of the at least one guiding rail is the same as a quantity of the plurality of driven elements.

17. The transformable molding assembly according to claim 1, wherein the at least one driving element comprises slopes, a quantity of which are the same as a quantity of the plurality of driven elements, the slopes are used to generate the at least one force to apply on the plurality of driven elements by slope theory.

18. The transformable molding assembly according to claim 1, wherein the at least one driving element of the at least one protrusion assembly in the first mode is moved from inside of the second plane toward outside of the second plane or from outside of the second plane toward inside of the second plane along the first direction.

19. The transformable molding assembly according to claim 1, wherein each of the at least one protrusion assembly in the first mode comprises at least one gap, a first area where the at least one protrusion assembly in the first mode occupies the second plane is less than a second area where the at least one protrusion assembly in the second mode occupies the second plane.

20. A transformable molding assembly, for a wet paper-shape forming equipment, comprising:

a lower mold, having a first plane and at least one cave formed on the first plane;

an upper mold, having a second plane and at least one guiding rail and at least one protrusion assembly, corresponding with the at least one cave, formed on the second plane, wherein the lower mold and the upper mold are matched with each other along a first direction, by the at least one cave and the at least one protrusion assembly; and an activation device, linked with the upper mold;

wherein the at least one protrusion assembly comprises at least one driving element, a plurality of driven elements and at least one fixing element, the plurality of driven elements are partially disposed in the at least one guiding rail, the activation device steers the at least one driving element to apply at least one force on the plurality of driven elements, with moving the plurality of driven elements along the at least one guiding rail, to reach a manner that an assembled shape of the at least one protrusion assembly is transformed either from a first mode to a second mode or from the second mode to the first mode, the at least one fixing element, which is used to guide the plurality of driven elements to move.

21. The transformable molding assembly according to claim 20, wherein the at least one force is applied on the plurality of driven elements along a second direction.

22. The transformable molding assembly according to claim 21, wherein the second direction is perpendicular to the first direction.

23. The transformable molding assembly according to claim 21, wherein the upper mold further comprises at least one first spring, each of the at least one first spring comprises a first end, the first end is linked with the plurality of driven elements, the plurality of driven elements are moved toward a third direction opposite to the second direction, by compressed elasticity provided by the at least one first spring.

24. The transformable molding assembly according to claim 23, wherein the at least one first spring further comprises a second end, the second end is linked with a side wall of the at least one guiding rail correspondingly.

25. The transformable molding assembly according to claim 23, wherein the at least one first spring further comprise a second end, the second end is linked with the at least one driving element.

26. The transformable molding assembly according to claim 20, wherein the activation device comprises one or a combination of several of a motor, a cylinder, and a pump, the activation device is physically linked with the at least one driving element.

27. The transformable molding assembly according to claim 20, wherein the at least one cave comprises a cave-top plane and a cave-surrounded plane, the at least one protrusion assembly comprises a protrusion-top plane and a protrusion-surrounded plane, the cave-top plane faces the protrusion-top plane, the cave-top plane and the protrusion-top plane are shaped correspondingly to each other, the cave-surrounded plane faces the protrusion-surrounded plane, and the cave-surrounded plane and the protrusion-surrounded plane are shaped correspondingly to each other.

28. The transformable molding assembly according to claim 27, wherein the cave-top plane can be either one of a flat plane, a sphere, and any geographic plane.

29. The transformable molding assembly according to claim 20, wherein a first area where the at least one protrusion assembly in the first mode occupies the second plane is less than a second area where the at least one protrusion assembly in the second mode occupies the second plane.

30. The transformable molding assembly according to claim 20, wherein the at least one protrusion assembly in the second mode further comprises at least one gap used to separate the plurality of driven elements.

31. The transformable molding assembly according to claim 20, wherein a quantity of the at least one guiding rail is the same as a quantity of the plurality of driven elements.

32. The transformable molding assembly according to claim 20, wherein the at least one driving element comprises slopes, a quantity of which are the same as a quantity of the plurality of driven elements, the slopes are used to generate the at least one force to apply on the plurality of driven elements by slope theory.

33. The transformable molding assembly according to claim 20, wherein the at least one driving element of the at least one protrusion assembly in the first mode is moved from inside of the second plane toward outside of the second plane or from outside of the second plane toward inside of the second plane along the first direction.

34. The transformable molding assembly according to claim 20, wherein the upper mold further comprises a first plate and a second plate, the at least one fixing element is fixed on the first plate, the at least one driving element is fixed on the second plate, the plurality of driven elements are movably disposed on the first plate.

35. The transformable molding assembly according to claim 34, wherein a first interval is defined between the first plate and the second plate in the first mode, a second interval is defined between the first plate and the second plate in the second mode, the second interval is less than the first interval.

36. The transformable molding assembly according to claim 35, wherein the upper mold further comprises at least one second spring disposed between the first plate and the second plate, the at least one second spring is used to provide elasticity for moving the plurality of driven elements of the at least one protrusion assembly along the first direction.

37. The transformable molding assembly according to claim 20, wherein each of the at least one protrusion assembly in the first mode comprises at least one gap, a first area where the at least one protrusion assembly in the first mode occupies the second plane is less than a second area where the at least one protrusion assembly in the second mode occupies the second plane.

38. A driving method for a transformable molding assembly, comprising:

disposing an upper mold, wherein the upper mold comprises a second plane, at least one guiding rail and at least one protrusion assembly, the at least one protrusion assembly comprises at least one driving element and a plurality of driven elements, the at least one protrusion assembly comprises a protrusion-top plane and a protrusion-surrounded plane;

dredging a wet paper pulp by a lower mold in a slurry tank, to make the wet paper pulp in at least one cave of the lower mold, a shape of the at least one cave corresponds with the at least one protrusion assembly, the at least one cave comprises a cave-top plane and a cave-surrounded plane, the cave-top plane faces the protrusion-top plane;

matching the lower mold and the upper mold with each other along a first direction, to combine the at least one cave and the at least one protrusion assembly to compress a part of the wet paper pulp on the cave-top plane;

driving the plurality of driven elements by the at least one driving element, to move along the at least one guiding rail, an assembled shape of the at least one protrusion assembly is transformed from a first mode to a second mode to compress at least one corner of the cave-surrounded plane;

driving the plurality of driven elements by the at least one driving element, to move along the at least one guiding rail, the assembled shape of the at least one protrusion assembly is transformed from the second mode to the first mode; and compressing the plurality of driven elements to at least one plane of the cave-surrounded plane, along at least one second direction orderly, the second direction is perpendicular to the first direction;

wherein the protrusion-top plane and the protrusion-surrounded plane are both smooth in the first mode, each of the at least one protrusion assembly further comprises at least one gap in the second mode, the at least one gap exists between the plurality of driven elements.

39. A driving method for a transformable molding assembly, comprising:

disposing an upper mold, wherein the upper mold comprises a second plane, at least one guiding rail and at least one protrusion assembly, the at least one protrusion assembly comprises at least one driving element and a plurality of driven elements, the at least one protrusion assembly comprises a protrusion-top plane and a protrusion-surrounded plane;

dredging a wet paper pulp by a lower mold in a slurry tank, to make the wet paper pulp in at least one cave of the lower mold, a shape of the at least one cave corresponds with the at least one protrusion assembly, the at least one cave comprises a cave-top plane and a cave-surrounded plane, the cave-top plane faces the protrusion-top plane;

matching the lower mold and the upper mold with each other along a first direction, to combine the at least one cave and the at least one protrusion assembly to compress a part of the wet paper pulp on the cave-top plane;

driving the plurality of driven elements by the at least one driving element, to move along the at least one guiding rail, an assembled shape of the at least one protrusion assembly is transformed from a first mode to a second mode to compress all of the cave-surrounded plane;

wherein the protrusion-top plane and the protrusion-surrounded plane are both smooth in the first mode, the protrusion-surrounded plane is smooth in the second mode.

40. A driving method for a transformable molding assembly, comprising:

disposing an upper mold, wherein the upper mold comprises a second plane, at least one guiding rail and at least one protrusion assembly, the at least one protrusion assembly comprises at least one driving element and a plurality of driven elements, the at least one protrusion assembly comprises a protrusion-top plane and a protrusion-surrounded plane;

dredging a wet paper pulp by a lower mold in a slurry tank, to make the wet paper pulp in at least one cave of the lower mold, a shape of the at least one cave corresponds with the at least one protrusion assembly, the at least one cave comprises a cave-top plane and a cave-surrounded plane, the cave-top plane faces the protrusion-top plane;

matching the lower mold and the upper mold with each other along a first direction, to combine the at least one cave and the at least one protrusion assembly and to make the at least one driving element to drive the plurality of driven elements move along the at least one guiding rail, to make an assembled shape of the at least one protrusion assembly transform from a first mode to a second mode to compress parts of the wet paper pulp on the cave-top plane and the cave-protrusion plane;

wherein the protrusion-top plane and the protrusion-surrounded plane are both smooth in the second mode.

* * * * *